United States Patent [19]

Gilman

[11] 4,053,194

[45] Oct. 11, 1977

[54] ELECTRICAL JUNCTION ASSEMBLY

[75] Inventor: Lester Gilman, Southampton, Pa.

[73] Assignee: Kidde Consumer Durables Corporation, Bala Cynwyd, Pa.

[21] Appl. No.: 682,938

[22] Filed: May 3, 1976

[51] Int. Cl.[2] ..... H01R 9/00

[52] U.S. Cl. ..... 339/21 R; 339/22 B

[58] Field of Search ..... 339/20–24; 174/71 B, 88 B

[56] References Cited

U.S. PATENT DOCUMENTS

| | | | |
|---|---|---|---|
| 3,605,064 | 9/1971 | Routh | 339/20 |
| 3,622,938 | 11/1971 | Ito | 339/21 R |
| 3,825,879 | 7/1974 | Hesse | 339/21 R |
| 3,871,730 | 3/1975 | Hesse | 339/21 R |
| 3,937,544 | 2/1976 | Valtonen | 339/21 R |

*Primary Examiner*—Roy Lake
*Assistant Examiner*—Mark S. Bicks
*Attorney, Agent, or Firm*—Seidel, Gonda & Goldhammer

[57] ABSTRACT

An electrical junction assembly is disclosed for electrically coupling mating bus bars of two adjacent tracks having single or double sets of bus bars. The assembly may contain the electrical conductors for supplying current to the bus bars. The assembly may be L, I, T or X-shaped. The assembly is removably coupled to the tracks in a manner to facilitate ease of coupling and uncoupling.

12 Claims, 8 Drawing Figures

ELECTRICAL JUNCTION ASSEMBLY

BACKGROUND

It is believed that the subject matter of the present invention is classified in Class 339, subclasses 21, 22 and 24. See U.S. Pat. Nos. 3,622,938; 3,783,203; 3,871,730; 3,794,955 and 3,825,879.

The prior art devices require too many separate components, require a complicated sequence and/or tooling to effect assembly of the junction assembly, and/or are unreliable in operation due to their design construction involving springs, and the like. These and other disadvantages are overcome by the junction assembly of the present invention.

DISCLOSURE

The electrical junction assembly of the present invention is primarily designed for electrically coupling mating bus bars of two adjacent tracks which may have single or double sets of bus bars. The assembly includes a non-conductive body portion having at least two legs and a ground overlying a part of said body portion. At least two mating distributor members are supported by the body portion.

Each distributor member has a body and at least two flanges generally perpendicular to a plane of the body. Each flange has at least one leg extending therefrom and each such leg has a tab lying generally perpendicular to its leg and generally parallel to its associated body.

The two distributor members are arranged in a set with a non-conductive spacer therebetween so that the tabs of a pair of legs extend outwardly away from each other beyond side faces of each leg of the body portion of the assembly. A means is provided for coupling the components of the junction assembly into an assembled relationship.

In the preferred embodiment of the present invention, the distributor members are identical and are positioned back to back to form a set. Springs or other adjustable components are eliminated. By having identical distributor members back to back, it is possible to thereby minimize the tooling required for production, minimize inventory, and minimize assembly procedures.

The non-conductive spacers between the distributor members of a set are likewise identical to thereby attain the advantages set forth above. If desired, conductors may be provided to couple a source of current to the distrubutor members whereby the distributor members mechanically couple the junction to two tracks and simultaneously constitute the means for introducing current into the bus bars of the tracks.

It is an object of the present invention to provide a novel electrical junction assembly having the advantages set forth above and other advantages as will be set forth hereinafter.

For the purpose of illustrating the invention, there is shown in the drawings a form which is presently preferred; it being understood, however, that this invention is not limited to the precise arrangements and instrumentalities shown.

Figure 1:
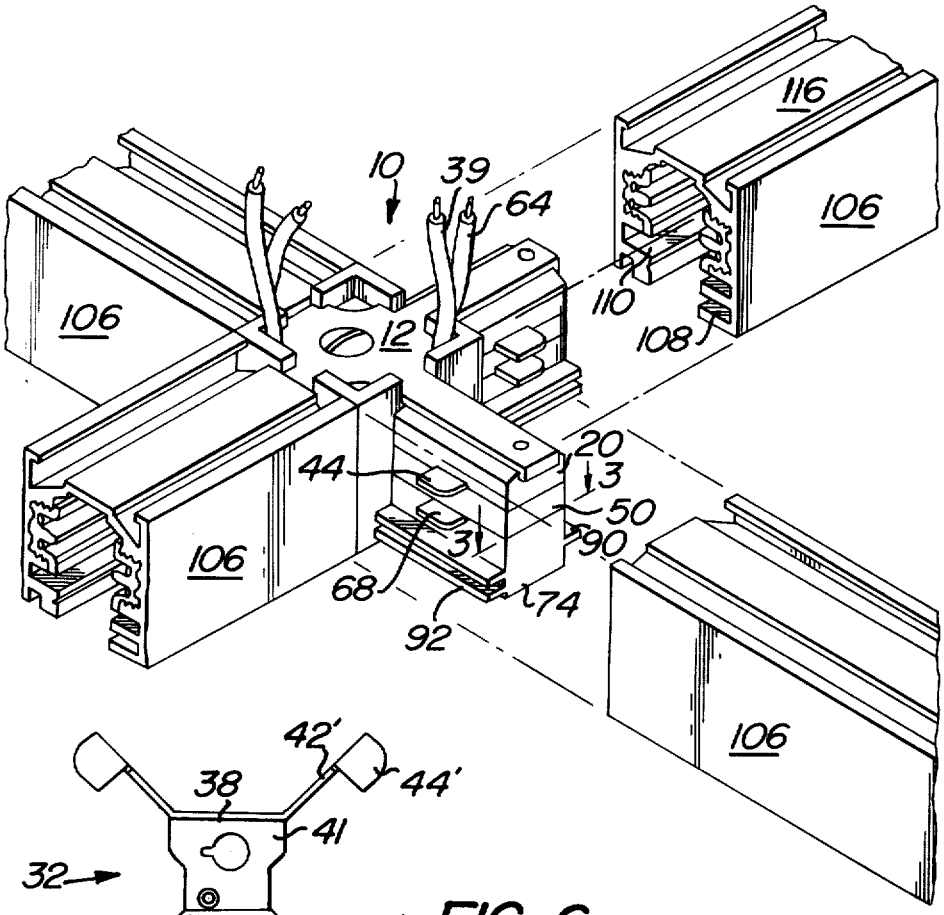
FIG. 1 is a perspective view of a X-shaped junction assembly in accordance with the present invention associated with end portions of four tracks.

Referring to the drawing in detail, wherein like numerals indicate like elements, there is shown in FIG. 1 a X-shaped electrical junction assembly 10 in accordance with the present invention. The components of assembly 10 are shown more clearly in FIG. 2.

Figure 2:
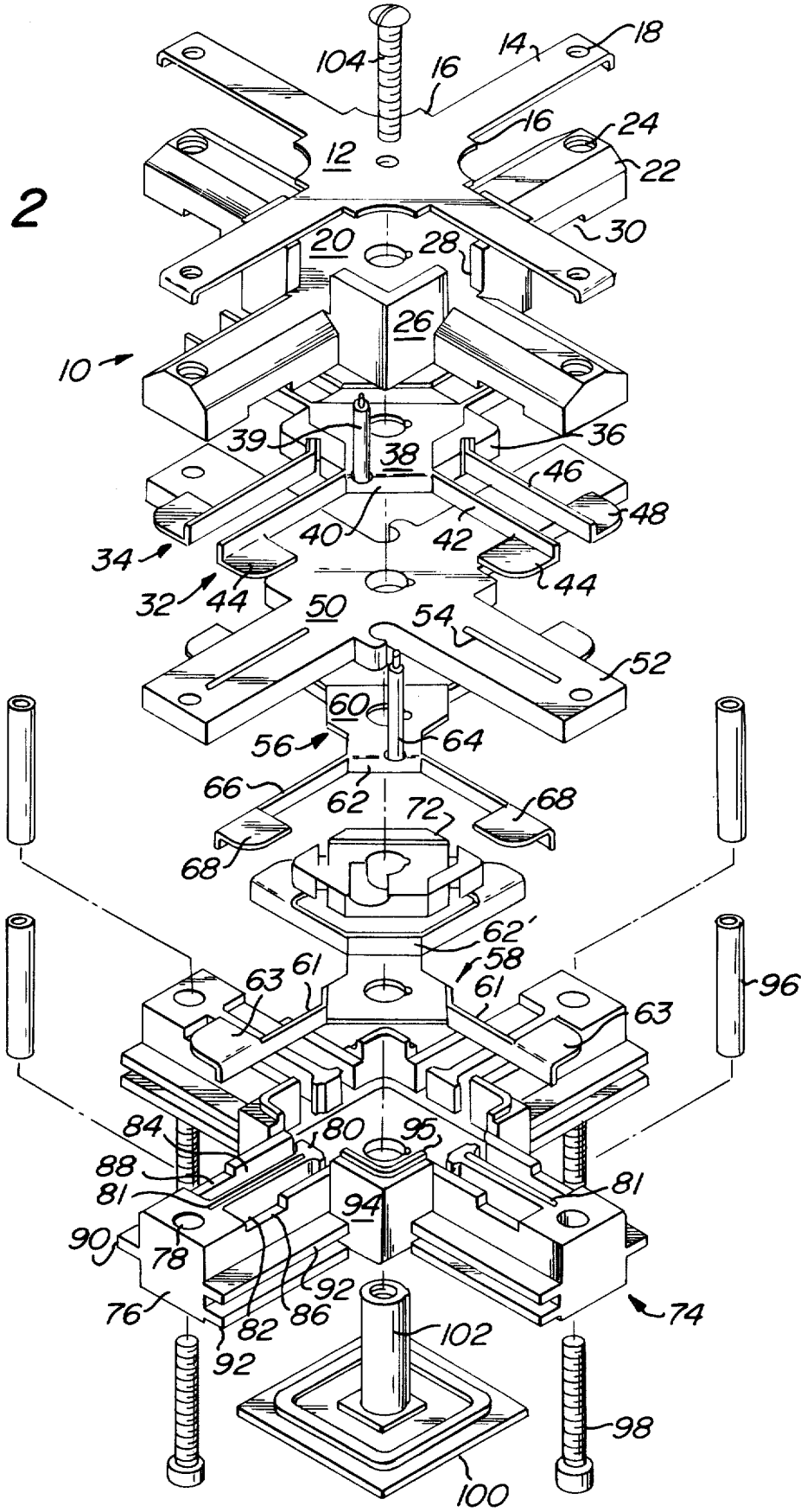
FIG. 2 is an exploded view of the X-shaped junction as shown in FIG. 1.
Figure 3:
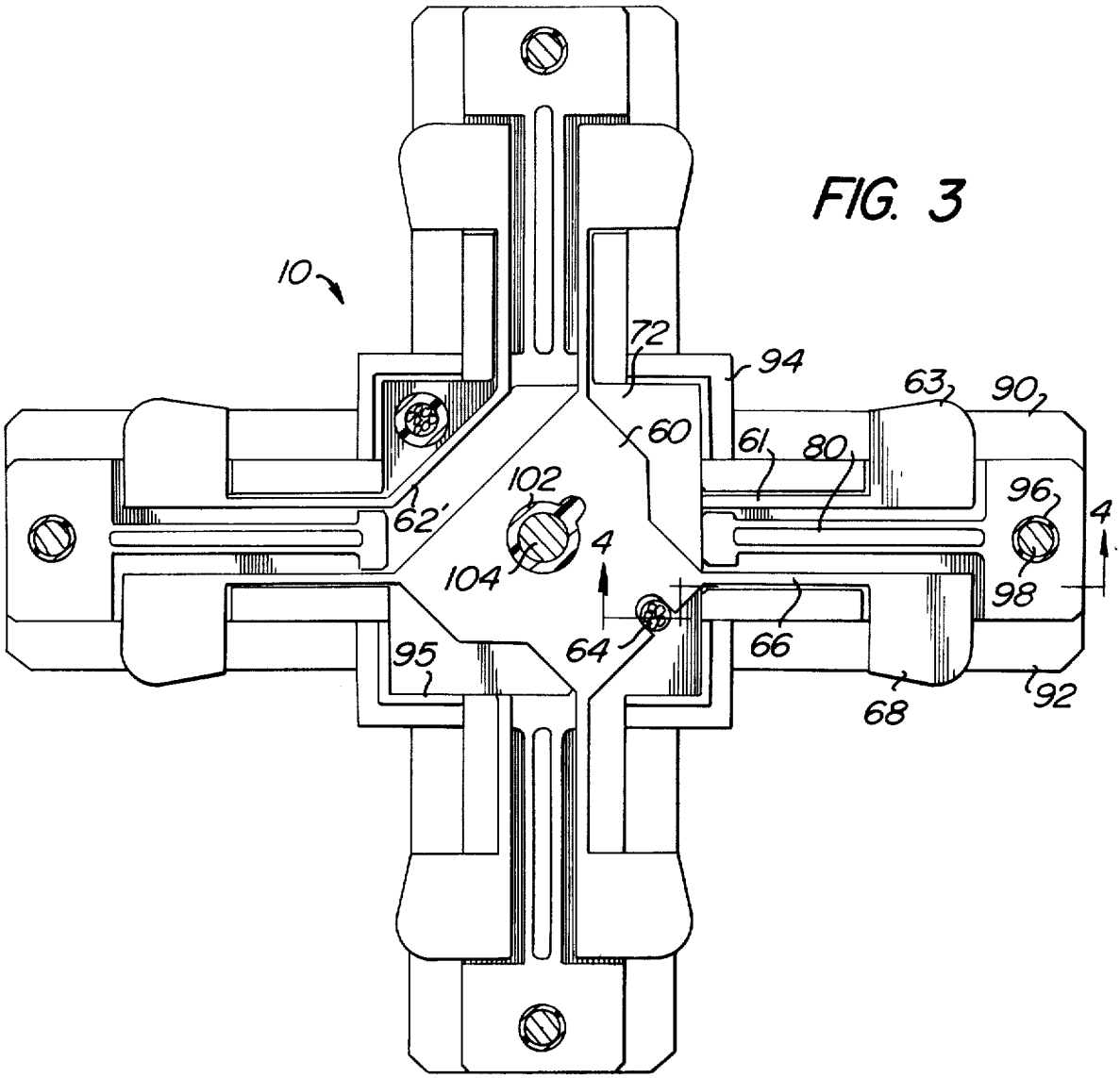
FIG. 3 is a top plan view of the lowermost body portion as seen along the line 3—3 in FIG. 1.

Referring to FIG. 2, the assembly 10 includes a ground plate 12 having a plurality of legs 14. The ground plate 12 is provided with notched corners and shoulders 16 on opposite sides of each of the legs 14. Each leg 14 has a threaded hole 18 for a purpose to be made clear hereinafter.

The body of the assembly 10 is made from a non-conductive material such as a polymeric plastic and is comprised of a plurality of body portions which are conveniently manufactured by injection molding or the like. The ground plate 12 overlies a first body portion 20 having a plurality of legs 22. Each leg 22 has a hole 24 which is larger in diameter than the holes 18. The body portion 20 has an upstanding wall 26 provided with a notch 28 aligned with each of the legs 22. The periphery of the wall 26 is sufficient to accommodate the ground plate 12 with each of the legs 14 extending through one of the notches. Each of the shoulders 16 abuts the wall 26 on opposite sides of the notch 28. The height of the wall 26 is greater than the thickness of the ground plate 12.

Each leg 22 is provided with a notch 30 on opposite sides thereof adjacent the lower periphery. Each notch 30 cooperates with a recess on the lower surface of each leg 22. The body portion 20 is provided with a recess on its bottom surface for receiving a set of distributor members 32 and 34 having an electrically non-conductive spacer 36 therebetween.

Figure 6:
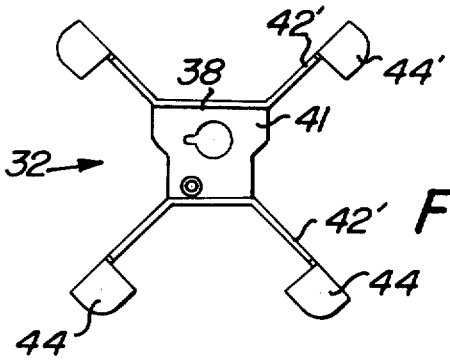
FIG. 6 is a perspective view of a distributor member.

The distributor members 32 and 34 are identical. As shown in FIGS. 2 and 6, distributor member 32 includes a flat body 38 having a downwardly extending flange 40 along one side. In FIG. 6, there is shown a bottom perspective view of the member 32 whereby the flange 40 extends upwardly. The flange 40 is on the narrow side of and is generally perpendicular to a plane of the body 38 and has a pair of legs 42 extending therefrom. The legs 42 are generally perpendicular to each other and each terminate at a lower edge in a tab 44.

The widest side of body 38 has a pair of discrete flanges 41 each having an integral leg 42' extending therefrom and terminating in a tab 44'. When the body 38 is horizontally disposed, the legs 42, 42' are defined by vertical side faces and each of the tabs 44, 44' lies in substantially the same plane as the body 38. Flange 40 is provided with a hole through which may extend an electrical conductor 39 having one end connected to body 38 if it is desired to have the junction 10 also arranged to introduce current into bus bars of tracks to be coupled thereto.

If the junction 10 is to include conductors for introducing current to bus bars, the first body portion 20 will have a pair of holes in diametrically opposite corners. The notches in the corners of ground plate 12 are sufficiently larger to accommodate a pair of conductors.

When the distributor members 32 and 34 are arranged in a set back to back with the spacer 36 therebetween, the legs 46 on the distributor member 34 are parallel to the legs 42 and the tab 48 on leg 46 is horizontally disposed at the same elevation at the tab 44. The thickness of the spacer 36 is slightly greater than the height of the legs 42, 46 and the thickness of the two bodies of the distributor members 32, 34.

Each of the legs 42 and 46 are received in a recess on the bottom surface of the leg 22 on the first body portion. Each of the tabs 44, 48 extends outwardly beyond a side face of leg 22 through one of the notches 30.

Below the distributor members 32, 34, there is provided a second body portion in the form of a spacer 50 of similar material. The spacer 50 has a plurality of legs 52 and a recess or groove 54 on the upper surface of each leg. Each groove 54 receives a rib on a divider wall on the lower surface of each of the legs 22. Diametrically opposite corners of the spacer 50 may be notched as shown to accommodate electrical conductors. Spacer 50 is eliminated if the junction 10 is used with tracks having a single set of bus bars.

Below the spacer 50 is provided another set of distributor members designated 56 and 58 which have an electrically non-conductive spacer 72 therebetween. Spacer 72 is identical with spacer 36 and is notched at its corners to receive the flanges on members 56, 58.

Each of the distributor members 56, 58 is identical to the distributor members 32, 34. Thus, the distributor member 56 has a body 60 with a downwardly extending flange 62 on one side thereof. A conductor 64 extends through a hole in flange 62 and is connected to body 60. The flange 62 has a pair of legs 66 each terminating in a tab 68. Each tab 68 lies below one of the tabs 44.

The distributor member 58 has a pair of upwardly extending flanges (like flanges 41) each having a leg 61 extending therefrom and terminating in a tab 63. The tabs 63 are disposed below the elevation of the tabs 48. Since the distributor members 56 and 58 are back to back, the flange 62' on members 58 which corresponds to flange 62 extends upwardly from the body of member 58.

Below the distributor members 56, 58, there is provided a third body portion 74 made from a similar material. Body portion 74 is provided with a plurality of legs 76 each having a hole 78. The diameter of the holes in each of the legs of the body portions 20, 50 and 74 are identical. On the upper surface of each leg 76, there is provided a divider wall 80 between parallel recesses 82 and 84 and containing an upstanding rib 81. The side walls of each leg 76 are provided with a notch 86 providing access to the recess 82 and a notch 88 providing access to the recess 84. The bottom surface on each of the legs 22 is constructed in the same manner as the upper surface of the legs 76. Hence, the bottom surface of each of the legs 52 of the body portion 50 are provided with a groove comparable to groove 54 for receiving the rib 81 on upper surface of the divider wall 80. See FIG. 4.

Each leg 76 is provided with an outwardly extending rib 90 on one side and a pair of outwardly extending ribs 92 on an opposite side. The purpose of the ribs 90, 92 will be described hereinafter.

Figure 4:
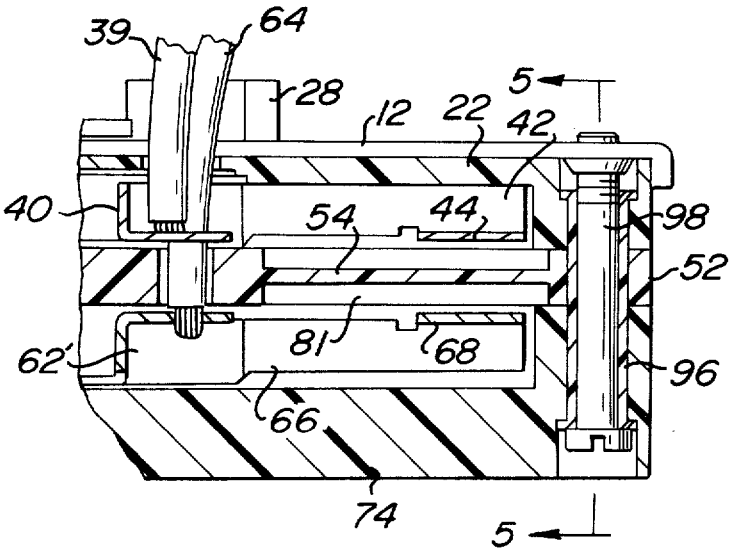
FIG. 4 is a sectional view taken along the line 4—4 in FIG. 3.

The third body portion 74 is provided an upstanding wall 94 notched to facilitate access between the recesses 84 and 82 and the interior of the body portion 74 inwardly of the wall 94. See FIG. 2. A means is provided to couple the thusly described components of the assembly into an assembled relationship. In a preferred embodiment, the coupling means includes hollow rivets 96. See FIG. 4. Threaded fasteners 98 extend through the hollow rivets 96 are threaded to the hole 18 and project slightly therebeyond. As shown in FIG. 4, the legs 76 are recessed to accommodate the head on fasteners 98.

If desired, the components of the assembly 10 may also be coupled together by way of a rectangular base 100 having an upstanding tube 102. The base 100 is rectangular and fits into a rectangular cavity in the bottom surface of the body portion 74. Each of the components except for the ground plate 12 have a centrally disposed hole and notch. A key on the tube 102 extends into the notch. The non-rotatability of the base 100 and the cooperation between the key on tube 102 and the notch on each of the centrally disposed holes prevents the components from rotating relative to one another. Further, the three body portions 20, 50 and 74 are coupled together with a rib 81 and groove 54 so that they may not rotate relative to each other as described above. A fastener 104 is threaded into the tube 102.

The height of wall 94 is sufficient so as to accommodate the thickness of the body portion 50 therewithin. On the upper edge of the wall 94, there is provided a L-shaped rib 95. Rib 95 is received within a correspondingly shaped recess on the lower surface of wall 26. Ribs 95 prevent body portions 20 and 74 from rotating particularly when body portion 50 is not used.

Figure 5:
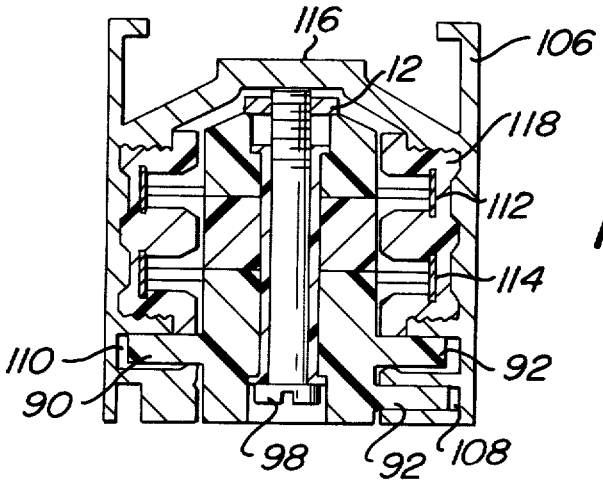
FIG. 5 is a sectional view taken along the line 5—5 in FIG. 4.

Referring to FIGS. 1 and 5, there is illustrated identical sections of a track 106. Track 106 is open at the bottom and provided with a top wall 116. Adjacent the open bottom, the track 106 is provided with a pair of recesses 108 on one side and a recess 110 on the opposite side. Track 106 is provided with an upper set of bus bars 112 and a lower set of bus bars 114. The bus bars of sets 112 and 114 on each side of the track 106 and are insulated from one another by an electrically non-conductive material 118.

Each leg of the assembly 10 is adapted to be telescoped into a track 106. The ribs 92 are each received in one of the notches 108. The rib 90 is received within the notch 110. Set screw 98 is rotated until it contacts the top wall 116 to thereby mechanically retain any leg of the assembly 10 in a coupled relationship to one of the tracks 106.

The assembly 10 electrically and mechanically couples one track 106 to another track 106. The tabs on the distributor members 32, 34, 56 and 58 electrically and mechanically couple the bus bars on one track 106 to corresponding bus bars on another track 106. While assembly 10 has two sets of distributor members, assembly 10 may be constructed so as to have only a single set of distributor members for use in connection with tracks that have only a single set of bus bars. Where the junction assembly 10 also includes electrical conductors, it constitutes the supply means for supplying current to the sets of bus bars 112, 114 on the tracks 106.

Figure 8:
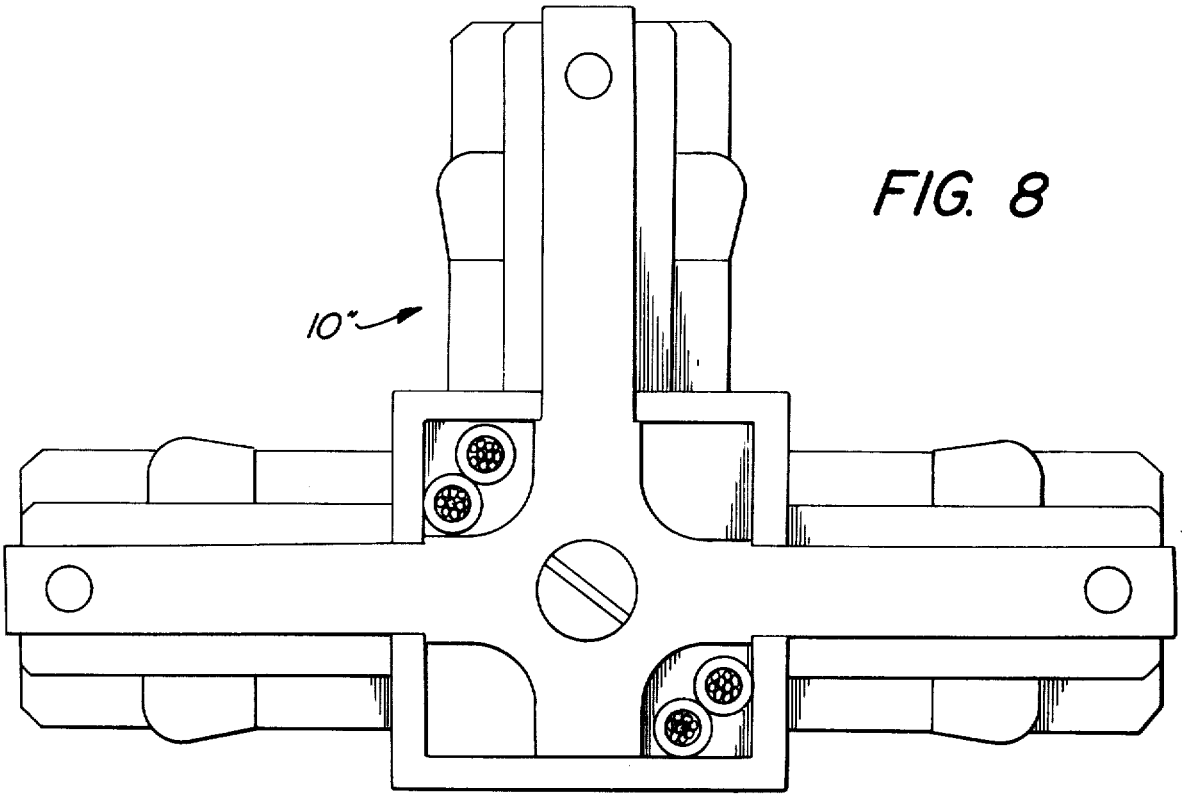
FIG. 8 is a top plan view of another embodiment of the present invention wherein the junction assembly is T-shaped.
Figure 7:
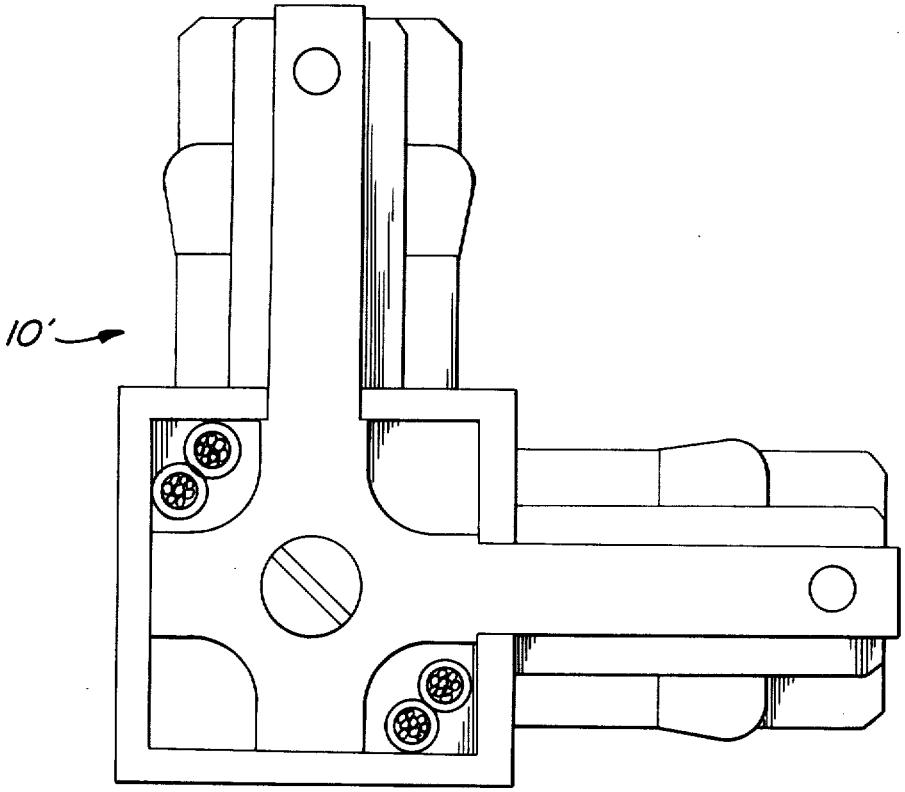
FIG. 7 is a top plan view of another embodiment of the present invention wherein the junction assembly is L-shaped.

In connection with the discussion of the preferred embodiment set forth above, the assembly 10 is X-shaped. As shown in FIG. 7, the electrical junction assembly 10' may be L-shaped. FIG. 8 there is illustrated another embodiment of the assembly designated 10" which is T-shaped. The assemblies 10' and 10" are identical with assembly 10 as described above, except for the shape of the assemblies in plan view.

The present invention may be embodied in other specific forms without departing from the spirit or essential attributes thereof and, accordingly, reference should be made to the appended claims, rather than to the foregoing specification as indicating the scope of the invention.

I claim:

1. An electrical junction assembly for electrically coupling mating bus bars of two adjacent tracks comprising a non-conductive body portion having at least two integral legs, a ground overlying a part of said body portion, at least two mating distributor members of electrically conductive material, each distributor member having a body and at least two flanges generally perpendicular to a plane of the body, each flange having at least one leg, each flange leg being integral in one piece with and extending from one end of its associated flange, each flange leg having a tab lying generally perpendicular to its leg and generally parallel to its associated body, said two distributor members being arranged in a set with a non-conductive spacer therebetween so that the tabs of a pair of legs extending outwardly away from each other beyond opposite side faces of each of said body portion legs, and means coupling said components into an assembled relationship.

2. An assembly in accordance with claim 1 including an electrical conductor connected to each distributor member for supplying current to bus bars of a track by way of said tabs, said conductors extending in a channel between said body portion and said non-conductive spacer.

3. An assembly in accordance with claim 1 including a set screw coupled to said ground and projecting upwardly therebeyond so that it may contact a wall of a track.

4. An assembly in accordance with claim 1 including a second body portion, said body portions being on opposite sides of said distributor members, one of said body portions having a projection and the other body portion having a recess receiving said projection, said projection and recess preventing relative rotation of said body portions.

5. An assembly in accordance with claim 1 wherein said body portion has a pair of ribs on one side of one leg and a rib on the opposite side of said one leg.

6. An assembly in accordance with claim 1 wherein said legs of said body portion are perpendicular to one another.

7. An assembly in accordance with claim 1 wherein said distributor members are made from flat metal and are assembled back to back.

8. An assembly in accordance with claim 1 wherein said non-conductive spacer between the mating distribution members is notched to receive the flanges on said distribution members.

9. An electrical junction assembly for electrically coupling mating bus bars of two adjacent tracks comprising first, second and third non-conductive body portions each having at least two legs, a ground plate overlying each leg of said first body portion, two sets of mating distributor members with said second body portion therebetween and each set juxtaposed to one of said first and third body portions, each distributor member having a flat body and at least two flanges generally perpendicular to a plane of the body, each flange having at least one leg, each flange leg being integral in one piece with and extending from one end of its associated flange, each flange leg having a flat tab lying generally perpendicular to its leg and generally parallel to its associated body, two of said distributor members being identical and arranged in a set back to back with a non-conductive spacer therebetween so that the tabs of a pair of legs extending outwardly at the same elevation away from each other beyond side faces of each leg of said body portions, and means coupling said components into an assembled relationship and preventing relative rotation.

10. An assembly in accordance with claim 9 including a discrete electrical conductor extending through said first body portion and connected to each distributor member for supplying current to bus bars of a track by way of said tabs.

11. An assembly in accordance with claim 9 wherein each distributor body is wider on one side than on the other side, the wide side of one distributor body being opposite the narrow side of the other distributor body of its set.

12. An electrical junction assembly for electrically coupling mating bus bars of two adjacent tracks comprising first, second and third non-conductive body portions each having at least two legs, said body portions being superimposed over one another with the second body portion being between the other body portions, a ground plate overlying each leg of said first body portion, a first set of two mating distributor members between said first and second body portions, a second set of mating distributor members between said second body portion and said third body portion, each set of distributor members including two distributor members having a non-conductive spacer therebetween, each distributor member having a flat body and at least two flanges generally perpendicular to a plane of the body, each flange having at least one leg integral in one piece therewith, each flange leg having a flat tab generally parallel to its associated body, the distributor members of each set being identical and arranged back to back so that the tabs of a pair of legs extend outwardly at the same elevation away from each other beyond side faces of each leg of said body portions, and means removably coupling said components into an assembled relationship and preventing relative rotation of the components thereof.

* * * * *